US005488940A

United States Patent [19]

Kugler et al.

[11] Patent Number: 5,488,940

[45] Date of Patent: Feb. 6, 1996

[54] IGNITION SYSTEM FOR INTERNAL COMBUSTION ENGINES

[75] Inventors: Karl-Heinz Kugler, Vaihingen; Walter Gollin, Moeglingen; Karlheinz Riedel, Vaihingen; Christian Zimmermann, Pleidelsheim, all of Germany

[73] Assignee: Robert bosch GmbH, Stuttgart, Germany

[21] Appl. No.: 211,584

[22] PCT Filed: Jul. 22, 1993

[86] PCT No.: PCT/DE93/00645

§ 371 Date: May 26, 1994

§ 102(e) Date: May 26, 1994

[87] PCT Pub. No.: WO94/03723

PCT Pub. Date: Feb. 17, 1994

[30] Foreign Application Priority Data

Aug. 8, 1992 [DE] Germany ..... 42 26 248.8

[51] Int. Cl.[6] ..... F02P 3/05; F02P 15/08

[52] U.S. Cl. ..... 123/644

[58] Field of Search ..... 123/609, 644

[56] References Cited

U.S. PATENT DOCUMENTS

| | | | |
|---|---|---|---|
| 3,624,487 | 11/1971 | Segall | 315/209 CD |
| 3,945,362 | 3/1976 | Neuman et al. | 123/609 |
| 4,773,380 | 9/1988 | Narita et al. | 123/644 |
| 4,899,715 | 2/1990 | Koiwa et al. | 123/644 |
| 4,915,086 | 4/1990 | Ciliberto et al. | 123/609 |
| 5,056,497 | 10/1991 | Akagi et al. | 123/609 |
| 5,127,388 | 7/1992 | Cicalese et al. | 123/644 |
| 5,208,540 | 5/1993 | Hoeflich | 123/644 |
| 5,370,099 | 12/1994 | Koelle et al. | 123/644 |

FOREIGN PATENT DOCUMENTS

| | | |
|---|---|---|
| 0281528 | 9/1988 | European Pat. Off. . |
| 2042360 | 9/1971 | Germany . |
| 57-028871 | 2/1982 | Japan . |
| 58-140475 | 8/1983 | Japan . |
| 59-018274 | 1/1984 | Japan . |

*Primary Examiner*—Willis R. Wolfe
*Attorney, Agent, or Firm*—Kenyon & Kenyon

[57] ABSTRACT

An ignition system for internal combustion engines is provided which has a control device (7) for triggering a sequential spark ignition, which measures the primary current ($I_p$) of each individual ignition of said sequential spark ignition upon the reconnecting of the flow of current, and which compares it with a reference value. The result of this comparison makes predictions possible concerning the conditions in the combustion chamber, and action, e.g. , increasing the primary disconnection current, can be taken by the control device so that for example any shunts which, are present can be eliminated.

8 Claims, 2 Drawing Sheets

IGNITION SYSTEM FOR INTERNAL COMBUSTION ENGINES

BACKGROUND OF THE INVENTION

An ignition system for producing sequential spark ignition is known in which a sequential spark ignition is triggered at the firing time and, as a result of the repeated successive control of the output stage upon each switching off of the current of the ignition coil an ignition spark is triggered on the secondary side. In this known arrangement, the ignition spark does not burn out before the time that the primary current is switched on again, so that a certain residual energy is present in the ignition coil upon the switching on again of the primary current. The charging of an individual ignition customarily has the same duration as the charging of the remaining individual ignitions of this sequential sparking ignition. This may have the result, particularly when losses of energy occur, for instance, in the ignition wiring or due to shunts at the spark plug, that the charging of an individual ignition is not sufficient to give off an ignition spark.

SUMMARY OF THE INVENTION

In accordance with the present invention the residual energy remaining in the coil is determined upon reconnection to the coil, and the conditions prevailing at the spark plug can be noted therefrom. Thus, it is possible, in the event of too little residual energy, to conclude that there is a shunt at the spark plug. Another advantage of the system according to the present invention is that, by the evaluation of the residual energy, it is possible to draw conclusions as to the formation of the mixture; thus, for instance, too low a residual energy permits the conclusion that there is a fat mixture while a very high residual energy permits the conclusion that there is a lean mixture. Particularly upon starting, it affords the possibility of improving the formation of the mixture. Finally, it may also be mentioned that by the recognition of a shunt, the disconnect current for the following individual ignition of the sequential spark ignition can be increased so that the spark plug may possibly burn itself free and the shunt be eliminated.

In accordance with a further embodiment of the present invention, the control device, after a comparison of the detected primary initial current with a predetermined reference value (this reference value being predetermined as a function of the operating condition and the type of engine) will, in the event of a smaller primary initial current than the reference value, increase the disconnect current for the following individual ignition by a switch member which is actuated by the control device. In this connection, it is particularly advantageous that the increase in the disconnect current is possible by increasing the base current of the output stage if the output stage is designed for this and is still not yet in a completely open condition (current limitation), since otherwise the disconnect current can be increased only by an increase in the closing time of the output stage. In this case, a higher supply voltage can be dispensed with. Furthermore the increase of the disconnect current of the following individual ignition can be increased by the lengthening of the closing time for this individual ignition if the output stage has not yet reached the current of the current limitation, i.e. if the current can rise further by an increase in the closed time. In this connection, neither a change in the supply voltage nor in the control signal is necessary for the output stage. The increase in the primary disconnect current can be effected, as desired, only for the following individual ignition or for several individual ignitions, the evaluation of the primary initial current in the control device being decisive.

DETAILED DESCRIPTION OF THE INVENTION

Figure 1:
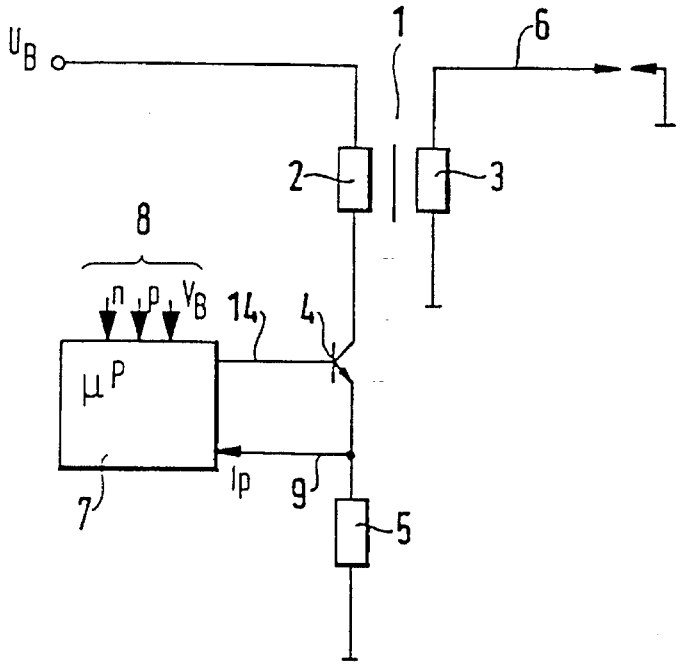
FIG. 1 shows the basic diagram of an ignition system of an internal combustion engine (not shown)

FIG. 1 shows the basic development of an ignition system having an ignition coil 1 consisting of primary winding 2 and secondary winding 3. The primary winding 2 is connected on one side to the supply voltage $U_B$ and on the other side to ground via the collector-emitter path of an ignition transistor 4 and a resistor 5. The secondary winding 3 is connected on one side directly to ground and on the other side, via a connection 6, to, for instance, a spark plug (not shown) or to a distributor (also not shown). A double spark coil would also be conceivable, in which case a spark plug is connected on each side of the secondary winding. The ignition system furthermore has a control device 7 which detects different operating parameters such as, for instance, speed of rotation, engine load, and supply voltage as input variables 8. From the output of the control device 7 a connection 14 furthermore extends to the base of the ignition transistor 4 so that the primary current can be connected to and disconnected from the ignition transistor by corresponding control signals. From the primary branch a tap with a connection 9 leads to the control device, whereby the primary current $I_p$ is in each case detected in the control device 7 via the voltage drop over the resistor in the primary circuit.

Figure 2:
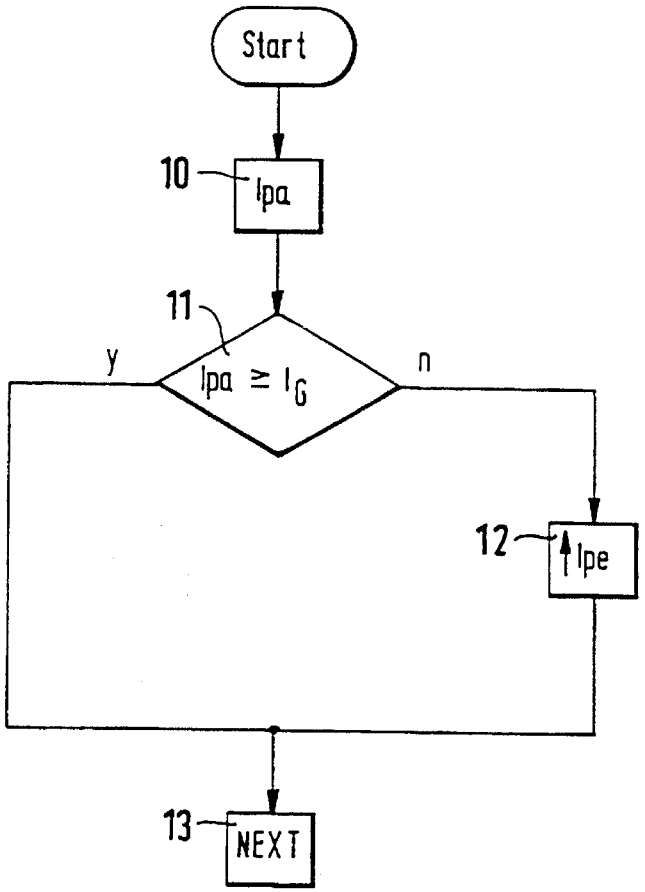
FIG. 2 shows the execution of a program for the detection and evaluation of the value of the primary initial current.

FIG. 2 shows a simplified program for the detection and evaluation of the primary initial current of an individual ignition EZ from a sequential spark ignition FFZ. The primary initial current $I_{pa}$ is detected in a work step 10 by the control device 7. In a following query 11, the primary initial current $I_{pa}$ detected is compared with a predeterminable reference value $I_G$, i.e. $I_{pa} \geqq I_G$ is tested. If this query is answered with a "no", then the output leads to step 12, i.e. the control device will for instance increase the disconnect current $I_{pe}$ for the following individual ignition EZ by, for instance, increasing the base current for the ignition transistor 4. Thereupon, in step 13, to which the "yes" output of the query 11 also leads, the primary initial current $I_{pa}$ of the next individual ignition EZ is detected and evaluated.

Figure 3:
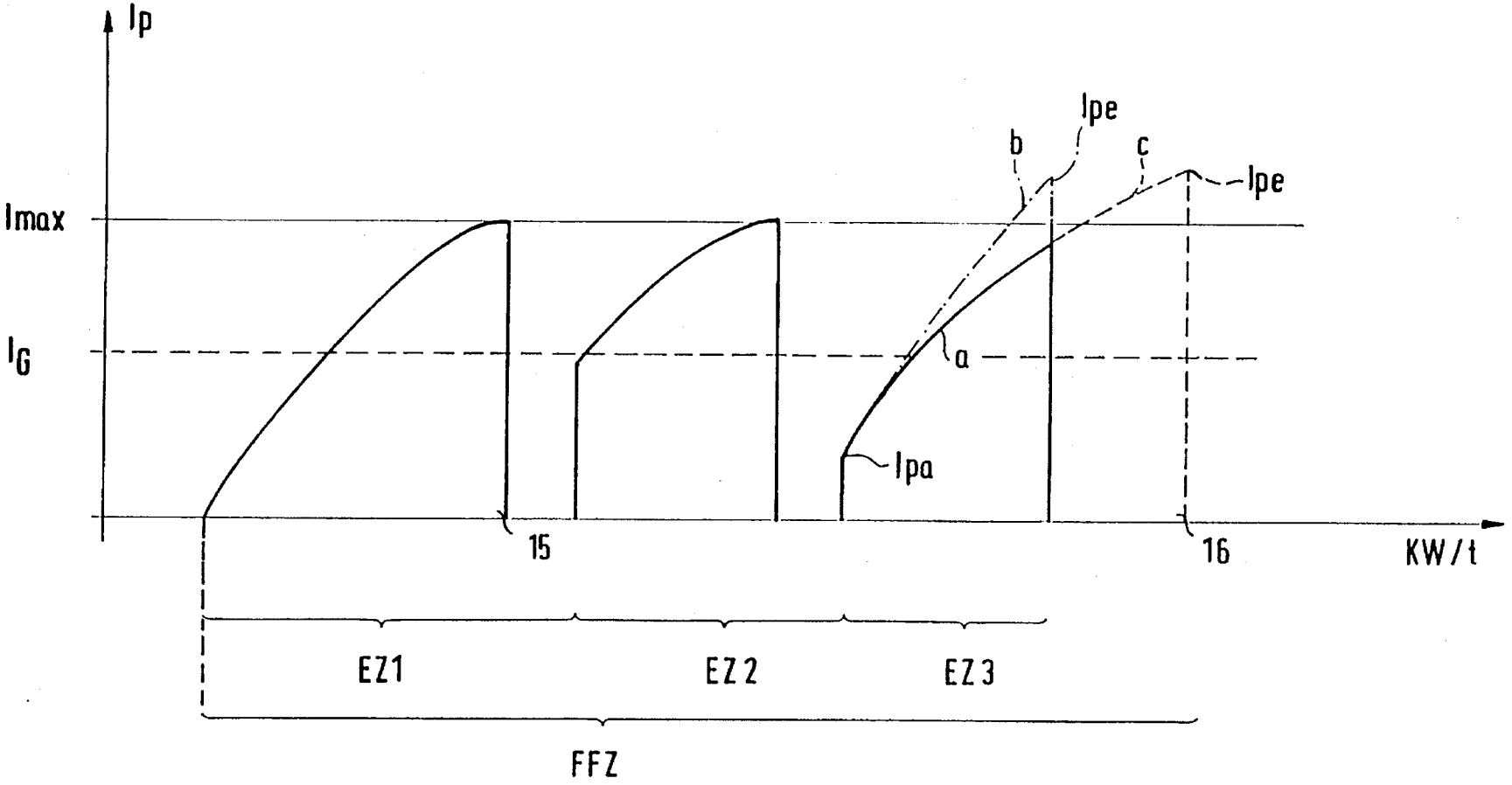
FIG. 3 shows a sequential spark ignition.

FIG. 3 shows the sequential spark ignition FFZ of an ignition coil, it consisting of individual ignitions EZ. In this case, the primary current $I_p$ is plotted over time or over the crankshaft angle, only that part of the crankshaft angle or of the time t in which the individual ignitions EZ of the sequential spark ignition FFZ are diagrammatically shown being indicated. The point 15 symbolizes the firing time of the internal combustion engine calculated by the control device 7 and the point 16 represents the point up to which individual ignitions can be triggered without the danger of the ignition taking place already in the following cylinder by rotation of the distributor rotor, or without the ignition taking place in the exhaust or intake cycle with the distributor at rest, leading to damage to the intake manifold or the like.

The individual ignitions are designated EZ1, EZ2, EZ3 in FIG. 3. Upon the individual ignition EZ3, it can be noted that the primary initial current $I_{pa}$ is clearly below the predetermined reference value $I_G$. If the base current of the ignition transistor is now maintained at the same height and with the same duration as in the case of the other individual ignitions EZ where the primary initial current $I_{pa}$ reaches the reference value $I_G$, this would lead to the curve a, in other words the disconnect energy might not be sufficient for the ignition spark. Therefore, the control device will see to it that the disconnect current in the primary winding 2 is increased. The dot-dash line b shows the course of the curve of the primary current as it occurs with an increased base current of the ignition transistor 4. It can be clearly noted that the disconnect current $I_{pe}$—and thus the energy for the ignition spark—is greater than for the previous individual emissions. In this way, a burning free of the spark plug may be made possible. The dashed line c shows the course of the curve such as obtained with a lengthened closing time for the individual ignition with too small a primary initial current $I_{pa}$; in this case also, the energy stored in the ignition coil is increased, so that the disconnect current $I_{pe}$ is higher and burning free of the spark plug may be made possible. By a detection of the primary initial current, information can also be obtained with regard to the composition of the mixture in the cylinder so that an increased primary initial current indicates a lean mixture, and a lower primary initial current a fat mixture, which can then be taken into account upon the control of the injection valves for the injection process for the following ignition.

What is claimed is;

1. An ignition system for an internal combustion engine comprising:

a measuring device for measuring a primary current in at least one ignition coil, wherein an initial primary current is a current measured upon connection of the primary current to the at least one ignition coil;

a control device for controlling a flow of current in the at least one ignition coil, the control device repeatedly connecting and disconnecting the primary current from the at least one ignition coil to trigger a sequential spark ignition via a plurality of individual ignitions, wherein the control device compares the initial primary current for each of the plurality of individual ignitions with a reference value, the control device increasing a disconnect current for the next one of the plurality of individual ignitions of the sequential spark ignition when the initial primary current is less than the reference value.

2. The ignition system according to claim 1 further comprising a switch coupled to the control device, the control device increasing the disconnect current when the initial primary current is less than the reference value by controlling the switch.

3. The ignition system according to claim 1 further comprising an ignition transistor coupled to the control device, and wherein the control device increases the disconnect current by increasing a current at a base terminal of the ignition transistor.

4. The ignition system according to claim 1, further comprising an ignition transistor coupled to the control device, and wherein the control device increases the disconnect current by lengthening a closed time of the ignition transistor.

5. A method for controlling an ignition system for an internal combustion engine, comprising the steps of:

measuring an initial primary current in at least one ignition coil, wherein the initial primary current is the current measured upon connection of the primary current to the at least one ignition coil;

comparing the initial primary current for each of a plurality of individual ignitions of a sequential spark ignition with a reference value; and increasing a disconnect current for the next individual ignition when the initial primary current is less than the reference value.

6. The method according to claim 5, wherein the step of increasing a disconnect current further includes the step of controlling a switch to increase the disconnect current when the initial primary current is less than the reference value.

7. The method according to claim 5, wherein the step of increasing a disconnect current further includes the step of increasing a current at a base terminal of an ignition transistor.

8. The method according to claim 5, wherein the step of increasing a disconnect current further includes the step of lengthening a closed time of an ignition transistor.

* * * * *